US007086574B2

(12) United States Patent
Dittrich et al.

(10) Patent No.: US 7,086,574 B2
(45) Date of Patent: Aug. 8, 2006

(54) EXPLOSION-OPERATED POWER TOOL

(75) Inventors: Tilo Dittrich, Feldkirch (AT); Gerhard Ehmig, Rankweil (AT); Thomas Sperrfechter, Grusch (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/737,278

(22) Filed: Dec. 16, 2003

(65) Prior Publication Data

US 2004/0178247 A1 Sep. 16, 2004

(30) Foreign Application Priority Data

Dec. 19, 2002 (DE) ..... 102 59 818

(51) Int. Cl.
*B25C 1/10* (2006.01)

(52) U.S. Cl. ..... 227/10; 227/9; 227/11

(58) Field of Classification Search ..... 227/8, 227/9, 10, 11, 201; 89/1.14, 26, 35.01
See application file for complete search history.

(56) References Cited

U.S. PATENT DOCUMENTS 3,087,428 A * 4/1963 Frech, Jr. ..... 102/531
3,435,765 A * 4/1969 Gawlick et al. ..... 102/531
3,690,536 A 9/1972 Bakoledis
3,804,314 A 4/1974 Gilbert
3,981,424 A * 9/1976 Maier ..... 227/10
4,114,792 A * 9/1978 Pomeroy ..... 227/8
4,130,231 A 12/1978 Iacoviello
4,406,079 A * 9/1983 Buechel et al. ..... 42/49.01
5,170,922 A * 12/1992 Ehmig et al. ..... 227/8
5,279,201 A * 1/1994 Jena et al. ..... 89/35.01
5,492,065 A * 2/1996 Jena et al. ..... 102/531
5,749,509 A * 5/1998 Remerowski ..... 227/10
6,286,743 B1 * 9/2001 Ehmig ..... 227/9
6,491,199 B1 * 12/2002 Wohlwend et al. ..... 227/10

FOREIGN PATENT DOCUMENTS

EP 1197301 4/2002
GB 1002292 8/1965

* cited by examiner

*Primary Examiner*—John Sipos
*Assistant Examiner*—Nathaniel Chukwurah
(74) *Attorney, Agent, or Firm*—Abelman, Frayne & Schwab

(57) ABSTRACT

An explosion-operated power tool including a housing (1) having a cylindrical cavity (5) and a piston chamber (2) for receiving a drive piston (3) and communicating with the cavity (5), a breech bottom (8) located opposite the cavity (5) and fixedly secured at a predetermined distance from the housing (1), and a sealing sleeve (12) located in the cavity (5) of the housing (1) and displaceable axially away from the breech bottom (8) and toward the breech bottom (8) for enabling, respectively, a sidewise feeding of a catridge (10) for positioning the catridge between the breech bottom and the sealing sleeve (12) and for securing the catridge between the breech bottom (8) and the sealing sleeve (12).

22 Claims, 8 Drawing Sheets

A
B

EXPLOSION-OPERATED POWER TOOL

BACKGROUND OF THE INVENTION

1. Field of the Invention

The present invention relates to an explosion-operated power tool and, in particular, to and explosion-operated setting tool for driving in fastening elements.

2. Description of the Prior Art

German Publication DE-199 05 896 A1 discloses an explosive powder charge-operated setting tool having a first part formed as a guide cylinder and a second part formed as a breech bottom. Both parts are arranged substantially coaxially with each other and are displaceable relative to each other parallel to the setting direction. An end region of the first part adjacent to the breech bottom has a catridge support. In the setting direction, a piston chamber adjoins the catridge support. A drive piston is displaceable in the piston chamber. A bore connects the piston chamber with the catridge support.

The breech bottom carries, at its end adjacent to the guide cylinder, a sealing sleeve displaceable in an axial direction. When a non-used catridge is located in the catridge support and the breech bottom is displaced in a direction toward the guide cylinder, the catridge is ignited, and the built-up, very high pressure pushes the sealing sleeve against the guide cylinder. This provides for a very reliable sealing of the catridge support in the region between the guide cylinder and the breech bottom.

However, in the setting tool of DE 199 05 896, there is danger that a very high pressure, which is generated at the catridge support, can damage sensitive parts of drive means which drives or displaces the breech bottom.

Accordingly, an object of the present invention is to provide a power tool, in particular, a setting tool of the type discussed above that is robust, can be easily manufactured, and has a reliably operating locking mechanism for the catridge support.

SUMMARY OF THE INVENTION

This and other-objects of the present invention, which will become apparent hereinafter, are achieved by providing a power tool including a housing having a cylindrical cavity, and a piston chamber for receiving a drive piston and communicating with the cavity, a breech bottom located opposite the cavity and fixedly secured at a predetermined distance from the housing, and a sealing sleeve located in the cavity of the housing and displaceable axially away from the breech bottom for enabling a sidewise feeding of a catridge for positioning the catridge between the breech bottom and the sealing sleeve and toward the breech bottom for securing the catridge between the breech bottom and the sealing sleeve.

The essential feature of the present invention is a rigid connection of the housing and the breech bottom with each other. The advantage of a rigid connection of the housing with the breech bottom consists in that after the ignition of the catridge, the high forces produced in the catridge support are absorbed by the rigid connection and do not load sensitive parts of a drive means. Such means for the breech bottom is not any more necessary, as it is fixedly connected with the housing and is not displaced any more. Drive means is used only for displacing the sealing sleeve. However, this drive means are not subjected to the gas pressure in the catridge support. Therefore, this drive means can have a simple structure and are driven only with small operational forces. The sealing sleeve should have a displacement path sufficient for insuring displacement of the catridges in a direction transverse to the direction of the axial displacement of the sealing sleeve for advancing the catridges in their ignition position and removing them after they have been used. The ignition position is located between the breech bottom and the sealing sleeve.

According to one embodiment of the invention, the central axes of the piston chamber and the cylindrical cavity extend at an angle toward each other, preferably, of 90°. This permits to realise the per se known, "side-fire" concept in a power tool of the type described above. An advantage of such an arrangement consists in that the catridges can be advanced to their ignition position along a path that extends parallel to the central axis of the piston chamber, i.e., parallel to the setting direction.

However, the central axes of the piston chamber and the cavity can be arranged coaxially with each other. In this case, the direction of displacement of catridges to their ignition position would extend transverse to the setting direction of the power tool.

According to a particularly advantageous embodiment of the present invention, the sealing sleeve has specific surfaces which provide for displacement of the sealing sleeve toward the breech bottom when these surfaces are subjected to a gas pressure produced by combustion of a catridge after it has been ignited.

In this way, the locking or sealing of the catridge support area is effected by a pressure force produced therein. A high gas pressure, which is produced in the catridge support or in the sealing sleeve upon combustion of the catridge, displaces the sealing sleeve toward the breech bottom to such an extent that no gas is able to escape between the breech bottom and the sealing sleeve. The gas pressure is only so high as required for a thin-walled blister catridge which can withstand an innerballistic pressure of several thousand bar.

As a pressure-receiving surface, a bottom surface of the sealing sleeve, which is spaced from the bottom of the cavity when the sealing sleeve receives the catridge, can be used, i.e., when the sealing sleeve is in the ignition position of the catridge. The sealing sleeve is displaced to this position by drive means. which axially displaces the sealing sleeve. The sealing sleeve can be provided with side projections for the drive means. When the sealing sleeve is in the ignition position, the high gas pressure, which is produced in the catridge support, acts on the bottom surface of the sealing sleeve, pressing the sealing sleeve toward the breech bottom.

As alternative to the additional pressure-receiving surfaces, an inwardly inclined section of the sealing sleeve formed at the end of the sealing sleeve facing the breech bottom, can be used. This inclined section likewise provides for displacement of the sealing sleeve toward the breech bottom upon high gas pressure produced in the catridge support acting thereon.

Preferably, the sealing sleeve is encompassed with seals for sealing a gap between the sealing sleeve and the inner wall of the cavity the sealing sleeve is located in. The seals insure an adequate sealing of the gap against penetration of gas therethrough.

Advantageously, the sealing sleeve has at its end remote from the breech bottom a circumferential recess formed in its end surface for forming a thin outer wall section which is pressed against the inner wall of the cavity when the gas pressure acts on the outer wall section.

Alternatively, or in addition, per se known FEY-rings can be provided between the sealing sleeve and the inner wall of the cavity. The sealing sleeve projects relatively far from the housing, which permits to provide the sealing sleeve with lugs necessary retaining and adjustment of the sleeve. After the sealing sleeve has been advanced toward the breech bottom for closing the catridge support, it projects rather far beyond the housing. This can cause friction problems, when the sealing sleeve is displaced into the housing, i.e., into the cavity, similar to those associated with a badly greased drawer which are skewed upon closing.

This problem is solved by displacing the sealing sleeve over a guide pin that extends from the housing in a direction toward the breech bottom and is located in the cavity. The guide pin can also be referred to as pedestal. The sealing sleeve is guided only inward by the pin. Thereby, the guide length is noticeably increased, and the non-guided length of the sealing sleeve is noticeably reduced. As a result, no tilting takes place during the displacement of the sealing sleeve.

Naturally, care should be taken to insure that high pressure, which is produced upon ignition of the catridge in the catridge support, is able to reach the piston chamber for driving the piston forward. To this end, the sealing sleeve can be provided with inner elongate channels to insure that the gas pressure, which is produced upon ignition of the catridge, is communicated to the piston chamber. Correspondingly, axial channels can be formed in the outer circumferential surface of the guide pin.

The use of the guide pin for guiding the sealing sleeve provides an additional advantage, reducing the empty space between the catridge and the piston. This permits to transmit a larger amount of energy to the piston for driving the same. Moreover, the guide pin heat can be removed outwardly, which improves cooling of the power tool.

Furthermore, the use of a guide pin permits to create a choke point. To this end, nose-shaped projections or simply noses are formed on the guide pin, which project into the elongate channels formed in the sealing sleeve.

For a good combustion of the propellant, it is advantageous to provide a choke point between the catridge and the piston. The closer in the choke point to the catridge the more effective the choke point is. In addition, care should be taken that the sealing sleeve has no surface at which the gas pressure can generate forces leading to displacement of the sealing sleeve away from the breech bottom. It is the opposite which is required. The sealing sleeve should have surfaces on which gas pressure can act to press the sealing sleeve more tightly to the breech bottom. As such surfaces, the already mentioned inclined sections at the end of the sealing sleeve facing the breech bottom can be used. The elongate channels start at these surfaces. Generally, a plurality of the axial elongate channels are formed in the inner surface of the sealing sleeve in a circumferentially spaced relationship relative to each other. As it also has already been mentioned, the guide pin is provided with at least one nose-shaped element or nose projecting into a respective elongate channel. The webs, which are formed between the axial elongate channels, guide the sealing sleeve along the guide pin. A catridge, a blister, cannot tear open at the locations of the webs. The advantage of this consists in that the catridge or blister does not tear. Rather, the catridge or blister can be removed from the catridge support as a whole part. This facilitate the operation of the power tool.

As it has also been discussed previously, the sealing sleeve is displaced toward the catridge ignition position by drive means. The sealing sleeve is displaced toward the breech bottom for enclosing a catridge. For building up high pressure in the catridge support or the combustion space upon ignition, it is necessary that the sealing sleeve be already pressed with a small force against the breech bottom in order to provide a necessary tightness at the catridge support. To this end, there is provided spring means for biasing the sealing sleeve against the breech bottom. The drive mechanism provides for application of the biasing force to the sealing sleeve. With the drive mechanism, the sealing sleeve is displace toward and away form the breech bottom.

The use of spring means for displacing the sealing sleeve permits to compensate tolerances of the drive mechanism.

According to another advantageous embodiment of the present invention, an actuation element is provided at the front end of the power tool and which is displaceable relative to the housing for operating a mechanism for displacing the sealing sleeve. The displacing mechanism displace the sealing sleeve toward and away from the breech bottom upon displacement of the actuation element toward the housing and away therefrom, respectively.

In this way, the displacement of the sealing sleeve is connected with displacement of the power tool against an object into which a fastening element is to be driven. This likewise facilitate the operation of the power tool.

According to a further preferred embodiment of the present invention, the displacement mechanism includes a spring fork that holds the sealing sleeve and that is lifted against its own biasing force upon displacement of the actuation element toward the housing. This takes place when the power tool is pressed with its tip against an object into which the fastening element is to be driven. With their displacement of the actuation element, the spring fork is lifted, and the sealing sleeve is biased against the breech bottom. Thereby, a provisional sealing of the catridge support or the combustion space takes place, which permits to build up high pressure in the catridge support or the combustion space upon ignition of the catridge.

According to a yet another embodiment of the present invention, it is possible to advance catridge between the sealing sleeve and the breech bottom dependent on the displacement position of the actuation element, i.e., to advance the catridge to the ignition position and to remove it therefrom. When the actuation element is displaced toward the housing, the adjusting mechanism can be preloaded to then displace a lifted catridge out of the ignition position and to advance a next catridge into the ignition position after the actuation element has been withdrawn from the housing a sufficient distance, and the sealing sleeve has been displace sufficiently far from the breech bottom.

As catridges, blister catridge can be use which are connected with each other, forming a belt. This insures an easy advance of the catridges to the ignition position and their removal therefrom.

Advantageously, the blister catridges project from one side of the belt, and the other, flat belt side abuts the breech bottom. The other, back side can be provided with an electrically conducting foil which can serve as a matching electrode, providing for formation of an electrical arc between an anode and the matching electrode. The anode can be arranged in the breech bottom.

According to an improved embodiment of the present invention, the end surface of the sealing sleeve facing the breech bottom can have a circumferential nose-like projection extending in the axial direction and located, when viewed in the radial direction, inwardly.

Generally, it is highly desirable to achieve as high as possible tightness between the sealing sleeve and the breech bottom already at a small gas pressure and a small application pressure, in particular when blister catridges are used.

The high initial tightness advantageously is achieve by deformation of the blister foil. To hold the necessary therefor, application forces small, the deformation is effected with a smallest possible nose-shaped projection or a smallest possible cutter. In order to prevent the foil of the blister catridge from being pierced by application of high closing forces generated by high pressure, the sealing sleeve is advanced against a stop to keep the cut height or depth as small as possible so that the cutter would not penetrate through the foil. The stop takes place against the foil at an even region of the end surface of the sealing sleeve. The advantage of this consists in that the tolerances can be easily maintained as only two dimensions need to be taken into account. It is to be noted that support region on the foil is large in comparison to the foil thickness. This presents extrusion of the foil under high closing forces.

According to a further embodiment of the invention, the end surface of the sealing sleeve facing the breech bottom extends parallel thereto, and on the breech bottom, there is provided a circumferential nose-shaped projection facing the proximate surface of the sealing sleeve.

This nose-shaped projection on the breech bottom permits to achieve a relatively high initial tightness already at a small gas pressure and a small application pressure. Naturally, here also care should be taken that the nose-shaped projection does not pierce the blister foil when it penetrates the back side of the catridge belt.

According to a still further embodiment of the invention, the end surface of the sealing sleeve facing the breech bottom extends parallel thereto, and the breech bottom has a truncated cone-shaped projection facing the adjacent or proximate end surface and projecting thereinto when the sealing sleeve is displaced against the breech bottom. The inner circumferential edge of the sealing, which is located opposite the breech bottom, does not contact the circumferential surface of the disc-shaped projection, which is inclined with respect to the axial direction of the sealing sleeve. The blister foil of the catridge strip is squeezed when the sealing sleeve is displace toward the breech bottom. However, no catridge strip separation takes place.

The last-named projection can be made circular and it has its circumferential edge located opposite the inner edge of the sealing sleeve. With this, the circumferential edge of the projection can penetrate more or less into the plastic foil of the blister catridge to insure a sealing effect.

The novel features of the present invention, which are considered as characteristics for the invention, are set forth in the appended claims. The invention itself, however both as to its construction and its mode operation, together with additional advantages and objects thereof, will be best understood from the following detailed description of preferred embodiments, when read with reference to the accompanying drawings.

DETAILED DESCRIPTION OF THE PREFERRED EMBODIMENTS

A first embodiment of a power tool according to the present invention, which is shown in FIGS. 1–6, relates to an explosive powder charge—operated setting tool for driving fastening elements in constructional components.

Figures 1, 2, 3:
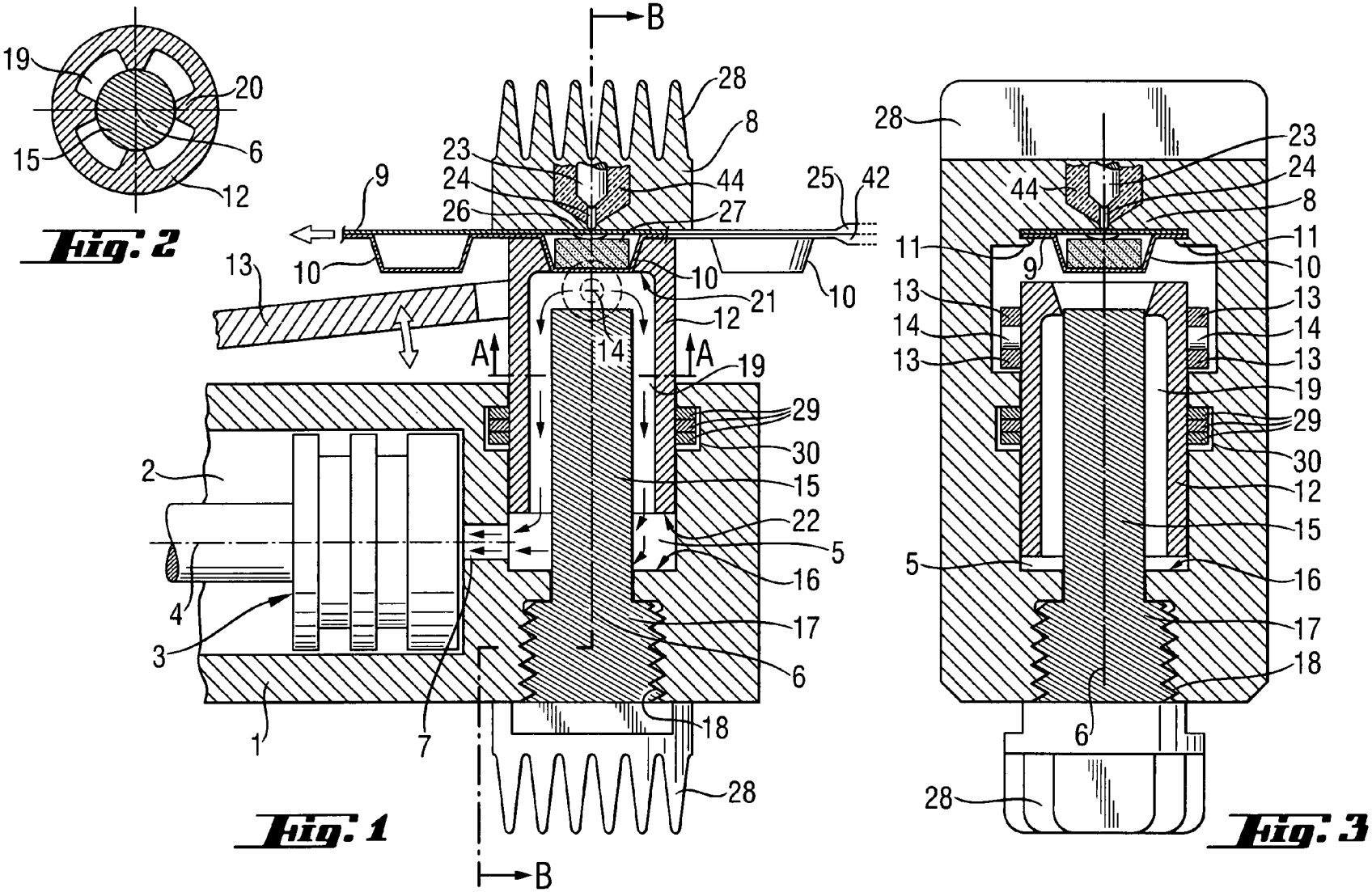
FIG. 1 an axial cross-sectional view of an explosion—operated power tool according to the present invention in the region of a sealing sleeve.
FIG. 2 a cross-sectional view along line A—A in FIG. 1.
FIG. 3 a cross-section view along line B—B in FIG. 1.

The setting tool, a section of which is shown in FIGS. 1–3, has a housing in which a cylindrical piston chamber 2 is formed. A drive piston 3 is arranged in the piston chamber 2 for axial displacement therein. The central axis 4 of the piston chamber 2 extends in a longitudinal direction of the setting tool. In the housing 1, there is provided a cylindrical cavity 5 the central axis 6 of which extends transverse to the central axis 4 of the piston chamber 2. A connection channel 7, which is coaxial with the central axis 4 of the piston chamber 2, connects the piston chamber 2 with the bottom region of the cylindrical cavity 5.

A breech bottom 8, which is formed as a massive part, is located opposite the open side of the cavity 5. The breech bottom 8 is fixedly secured at a predetermined distance from the housing 1. The breech bottom 8 can be fixedly connected with the housing 1 or be formed as a one-piece part therewith, as shown in FIG. 3. The surface of the breech bottom 8 which faces the housing 1, is substantially flat in its region facing the cavity 5 and serves for guiding a belt 9 with blister catridges 10. The blister catridges 10 are located only on one side of the belt 9 so that the belt 9 can snugly slide with its backside along the flat surface of the breech bottom 8. The belt 9 is displaced in the direction of the central axis 4 of the piston chamber 2 or in the longitudinal direction of the setting tool, as shown in FIG. 1. The belt 9 is supported, at its opposite longitudinal sides, by holding noses 11, which engage the belt 9 from beneath and are spaced from the breech bottom 8. With displacement of the belt 9 in the longitudinal direction, separate blister catridges are brought into the ignition position which is located opposite the cavity 5.

A sealing sleeve 12, which is displaceable in its longitudinal direction, i.e., along the central axis 6, is slidably arranged in the recess 5. The sealing sleeve 12 can, on one hand, be pressed against the breech bottom 8, pinching respective regions of the blister catridge belt 9 located between the blister catridges 10 against the breech bottom 8. Thus, the sealing sleeve 12 surrounds a blister catridge 10 located in the ignition position. In this displacement position of the sealing sleeve 12, the connection channel 7 remains free. The axial length of the sealing sleeve 12 is so selected that it ends, in its displacement position slightly above the connection channel 7. Another displacement position of the sleeve 12 is shown in FIG. 3. In this position, the sealing sleeve 12 is displaced to a most possible extent into the cavity 5. In this position of the sealing sleeve 12, the lower end of the sealing sleeve 12 closes the connection channel 7, on one hand, and, on the other hand, the upper end of the sealing sleeve 12 is spaced from the breech bottom 8 sufficiently far to insure displacement of the belt 9 in the longitudinal direction of the setting tool or along the central axis 4.

The displacement of the sealing sleeve 12 is effected by a spring fork 13 which is displaced up and down as shown in FIG. 1 with a double arrow. The spring fork 13 encompasses the upper end of the sealing sleeve 12, holding the sealing sleeve 12 over the axle stubs 14 provided on opposite sides of the sealing sleeve 12, as shown in FIG. 3. The lifting and lowering of the spring fork 13 takes place in accordance with the displacement of the setting tool toward and away from an object in which a fastening element is to be driven by the setting tool. When the tip of the setting tool is pressed against the object, the spring fork is 13 is lowered, pulling the sealing sleeve 12 back into the cavity 5. When the sealing sleeve 12 is displaced against the breech bottom 8 by the spring fork 13, the spring fork 13 presses the free circumferential edge of the sealing sleeve 12 with a certain initial pressure force against the catridge belt 9, providing a certain initial tightness between the sealing sleeve 12 and the breech bottom 8. The displacement of the spring fork 13 and the displacement of the blister catridge belt 9 will be explained in detail further below.

As shown in FIGS. 1–3, the sealing sleeve 12 is displaced over a guide pin 15. The guide pin 15 is formed as a cylindrical body extending coaxially with the central axis 6 of the cavity 5. The guide pin 15 has an outer threaded section 17 which is screwed in a inner thread 18 provided in the housing 1. The axial length of the guide pin 15 is so selected that in its screw-in position, the free end surface of the guide pin 15 is located above the cavity 5 not far from the blister catridge 10 located in the ignition position. The guide pin 15 is designed not only for guiding the sealing sleeve 12 and preventing it from tilting during the displacement of the sealing sleeve 12 but also for reducing the volume of the free space between a blister catridge 10 and the drive piston 3. This prevents the gas, which is produced upon ignition of the blister catridge 10, from expanding in a large space which would have reduced the setting tool efficiency.

In order for the gas pressure to be transmitted into the piston chamber 2, the space beneath a blister catridge 10, when the blister catridge 10 is located in the ignition position, should be connected with a region of the cavity 5, which is located beneath the sealing sleeve 12. The this end, the sealing sleeve 12 is provided, on its inner surface, with longitudinal groove-shaped channels 19. The channels 19, as shown in FIG. 2, are circumferentially equidistantly spaced from each other. In the embodiment shown in FIGS. 1–3, the sealing sleeve 12 has four channels 19. The webs 20, which are provided between respective channels 19, support the sealing sleeve. 12 on the guide pin 15. The channels 19 begin beneath the end surface of the sealing sleeve 12 facing the breech bottom 8 and extend up to the lower end of the sealing sleeve 12. The advantage of such arrangement of the channels 19 consists in that the high pressure, which is generated in the catridge chamber upon ignition of the blister catridge 10, does not act on any surface of the sealing sleeve 12 through which a pressure force can be transmitted to the sealing sleeve 12 for displacing the sleeve 12 away from the breech bottom 8. Actually, an opposite force acts on the sealing sleeve 12. The gas pressure only acts on surfaces of the sealing sleeve 12 through which a closing force is transmitted to the sealing sleeve 12. These surfaces are end surfaces 21 of the channels 19 and the bottom surface 22 of the sealing sleeve 12. Thus, the high gas pressure, which is generated in the catridge support, displaces the sealing sleeve 12 further in the direction toward the breech bottom 8, providing for a very high sealing pressure. Thus, the locking is effected by the generated gas pressure itself.

For ignition of a blister catridge 10, which is located in the ignition position an anode 23 is provided in the breech bottom 8, with an electrical arc being generated, through the channel 24, between the anode 23 and an electrically conducting foil 25 that is provided on a back side of the belt 9. The electrical arc melts the foil on opposite, with respect to the catridge, side of the belt 9, igniting the initiating composition 26 that, in turn, ignites the propellant 27 in the catridge 10.

The heat is removed from the catridge support through the breech bottom 8 and the guide pin 15, with both being cooled with outer cooling ribs 28.

The sealing sleeve 12 is surrounded with piston rings 29 (so called FEY-rings) which are located in an annular space 30 in the wall of the cylindrical cavity 5. The piston ring 29 provide for sealing the gap region between the sealing sleeve 12 and the inner wall of the cylindrical cavity 5 when high pressure is generated within the catridge support as a result of ignition of the blister catridge 10.

Figure 4:
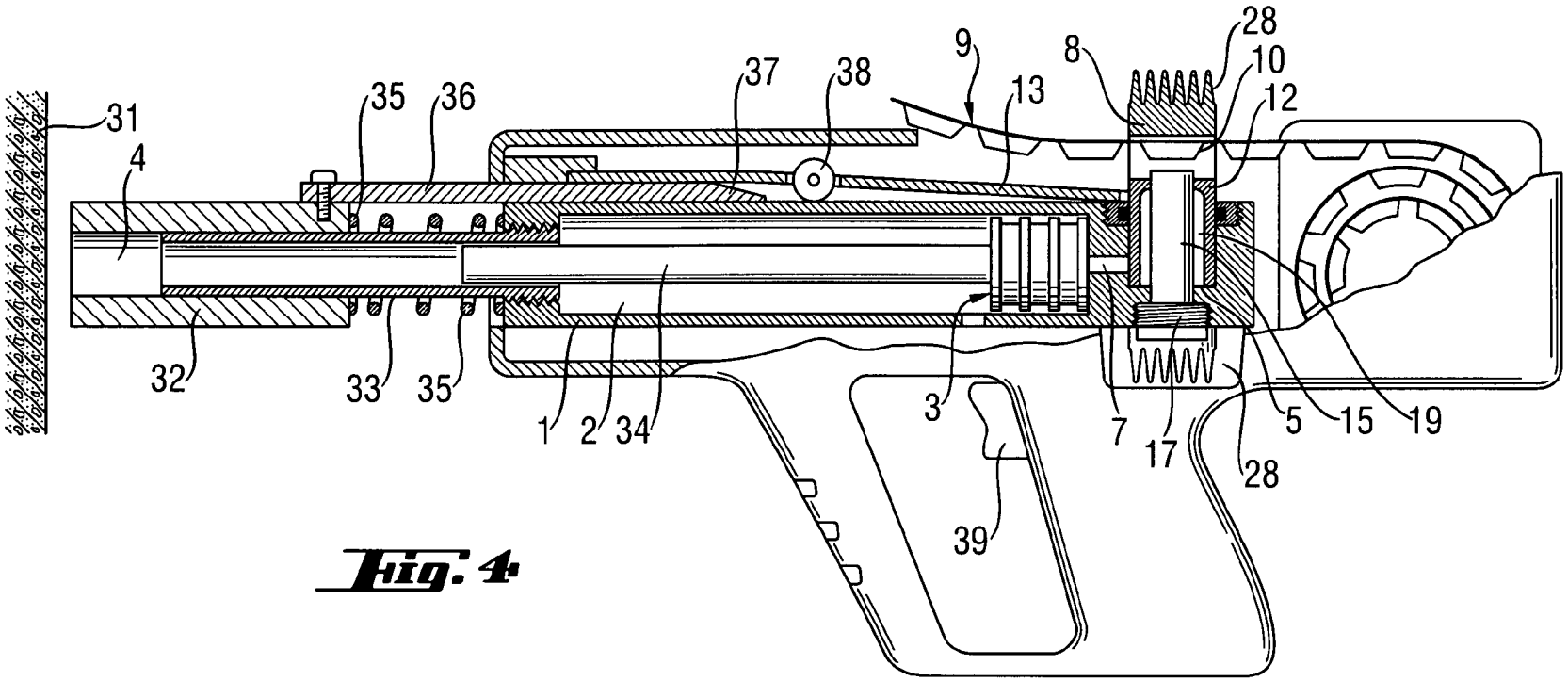
FIG. 4 a side, partially cross-sectional view of the power tool shown in FIG. 1 in a non-press-on condition.

FIG. 4 shows the setting tool in a non-press-on condition when the tool is not yet pressed, with its tip or mouth opening against an object 31. The setting tool shown in FIG. 4 is the same tool shown in FIGS. 1–3, with the same elements being designated with the same reference numerals. Therefor, they would not be described further.

The setting tool, which is shown in FIG. 4, includes an actuation element 32 displaceable relative to the housing 1 over a mouth tube 33 along the central axis 4. The mouth tube 33 is screwed into the housing 1. A piston rod 34 of the piston 3 extends into the mouth tube 33. The mouth tube 33 is surrounded with a compression spring 35 which is located between the front end of the housing 1 and an end surface of the actuation element 32 which faces the front end of the housing 1. The compression spring 35 biases the actuation element against a stop (not shown) away from the housing 1. An actuation rod 36 is fixedly connected with the actuation element 32. The actuation rod 36 extends along the central axis 4 into the housing. The actuation rod 36 has, at its end located within the housing 1, a wedge 37. The spring fork 13 is fixedly secured on the housing 1 at its mouth end, and the wedge 37 of the actuation rod 36 extends into the space between the spring fork 13 and the housing 1. An actuation wheel 38 is rotatably supported on the spring fork 13 at a distance from the sealing sleeve 12. When the setting tool is not pressed with its actuation element 32 against the object 31, the compression spring 35 presses the actuation element 32 forward, and the wedge 37 of the actuation rod 36 does not contact the actuation wheel 38. The sealing sleeve 12 is located in the cavity 5, and a non-ignited catridge 10 can be transported into the ignition position beneath the breech bottom 8 upon the setting tool being pressed against the object 31. For displacing the catridge 10 into the ignition position, the blister catridge belt 9 is advanced from a magazine 41 in which it is stored in form of a roll. The transportation of the blister catridges 10 can take place when the sealing sleeve 12 is displaced sufficiently far into the cylindrical cavity 5. The catridge 10 can be ignited upon actuation of a trigger 39 of the setting tool.

Figure 5:
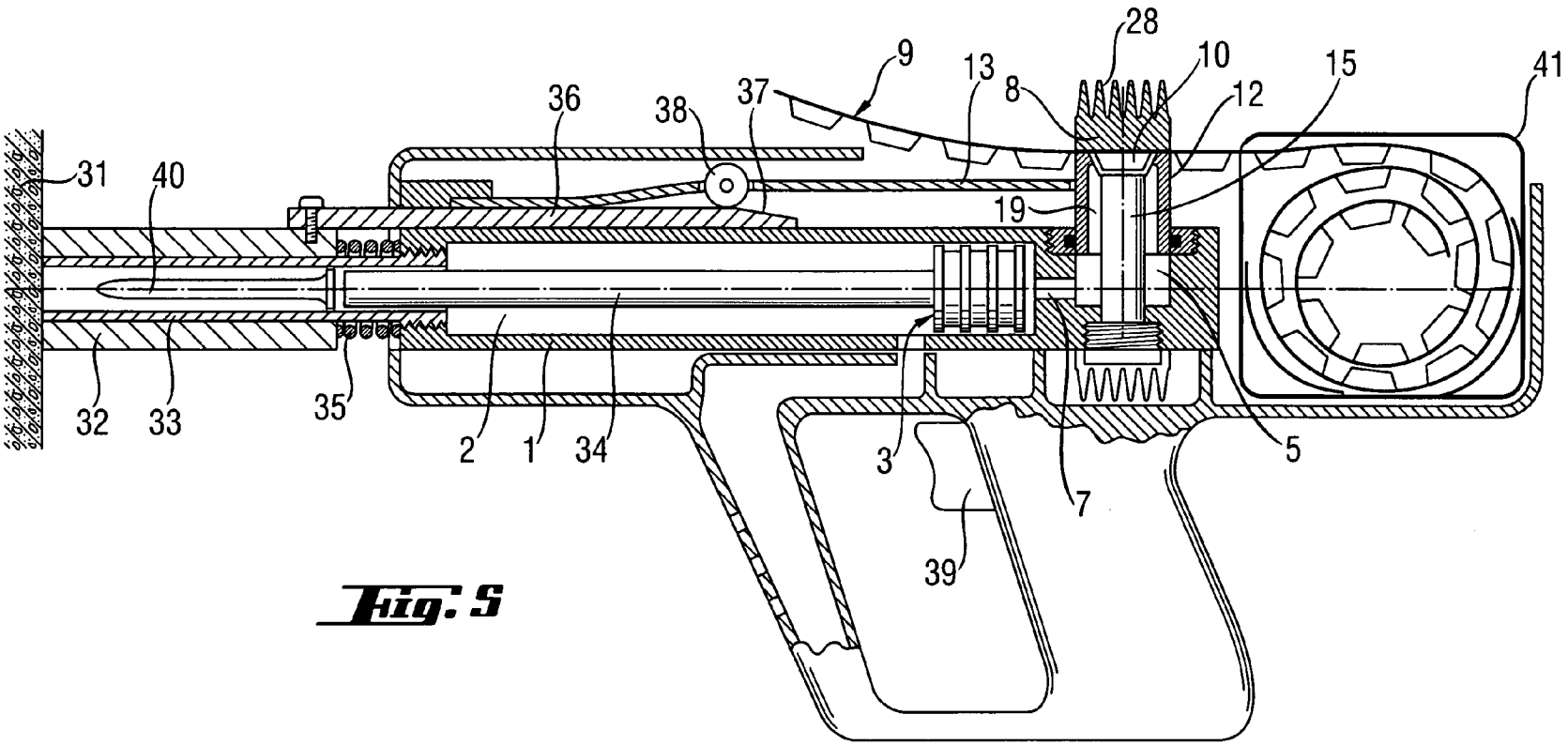
FIG. 5 a side, partially cross-sectional view of the power tool shown in FIG. 1 in a press-on condition.
Figure 6:
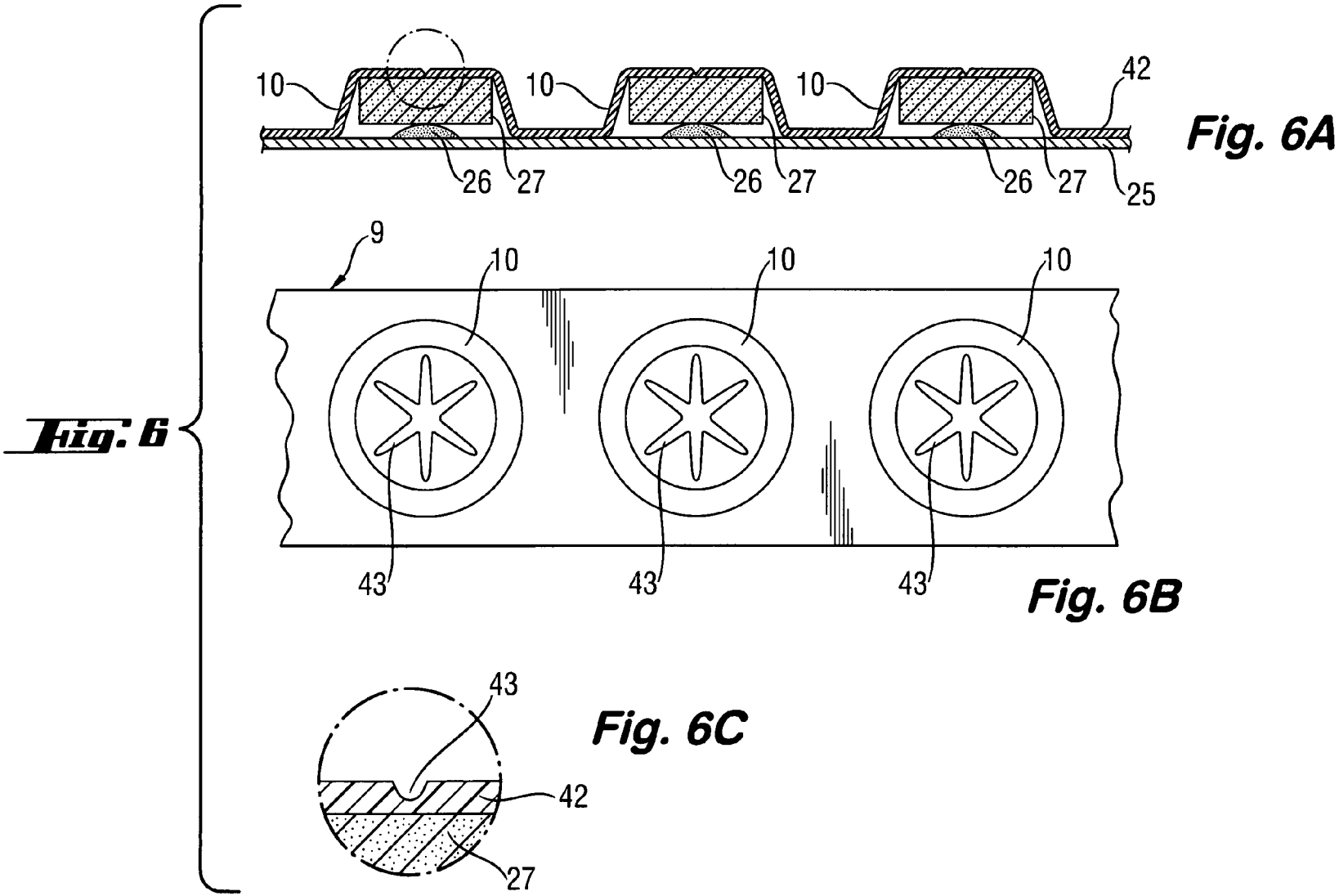
FIG. 6A a longitudinal cross-sectional view of a catridge strip with blister catridges.
FIG. 6B a plan view of a catridge strip with blister catridges.
FIG. 6C a cut-out view of a blister catridge at an increased scale.

FIG. 5 shows the setting tool in its press-on condition against the object 31. In this position of the setting tool, a fastening element 40, which is located within the mouth tube 33, can be driven into the object 31. The actuation element 32 is displaced in a direction toward the housing base 1, and the compression spring 35 is compressed. The actuation rod 36 is likewise advanced into the housing 1 of the setting tool, with its wedge 37 lifting the spring fork 13 via the actuation wheel 38. The sealing sleeve 12 is lifted by the spring fork 13 toward the breech bottom 8, with a force acting between the sealing sleeve 12 and the breech bottom 8 for sealing the gap between the sealing sleeve 12 and the catridge belt 9. Upon actuation of the trigger 39, a blister catridge 10 is ignited, and the sealing sleeve 12 is pressed further against the breech bottom 8, whereby the sealing effect is increased further. The high pressure, which is generated in the catridge support is transmitted via the connection channel 7 into the piston chamber 2 and drives the drive piston 3 forward.

FIGS. 6A, 6B, and 6C show, at an increased scale, details of the structure of the blister catridge belt 9. The belt 9 is formed of an electrically conductive foil. A plurality of initiating composition elements 26 are provided on the foil 25 in a spaced relationship to each other. Above an initiating composition element 26, lies a propellant 27. Separate groups of the initiating composition elements 26 and the propellants 27 are covered with a plastic film 42. The groups of the initiating composition element 26-propellant 27, and the plastic film 42 form together a plurality of blister catridges 10. Each of the blister catridges 10 has, in its embossed region, a rice star 43 formed in the plastic film 42, having in this region a reduced wall thickness. When a blister catridge 10 is in the ignition position, the star 43 coincides with the guide pin 15. Because of the star 43, the blister catridge 10 opens relatively quickly upon ignition of the propellant 27. This provides for highly efficient build-up of pressure.

Figure 7:
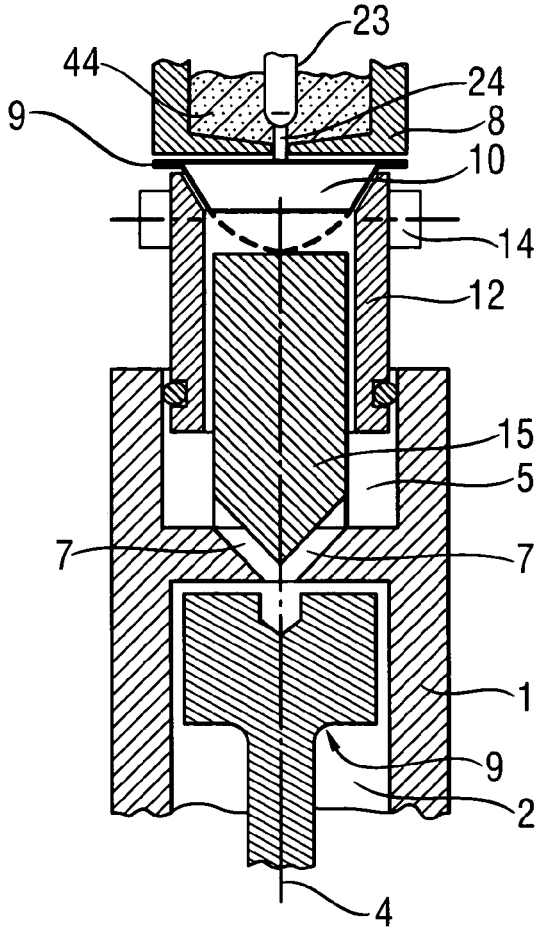
FIG. 7 an axial cross-section view of a power tool according to another embodiment the present invention.

A second embodiment of the inventive power tool is shown in FIG. 7. In the embodiment of FIG. 7 the same elements as in the embodiment of FIGS. 1–6 are designated with the same reference numerals, and they will not be described further. The embodiment shown in FIG. 7 primarily differs from that of FIGS. 1–6 in that the cylindrical cavity 5 is coaxial with the piston chamber 2 and is connected with the piston chamber by an inclined connection channel 7 which is formed at lower end of the cylindrical cavity 5. Because the press-on direction of the setting tool and the direction of the displacement of the sealing sleeve 12 coincide, the spring fork 13 for lifting and lowering of the sealing sleeve 12, the wedge 27 and the actuation wheel 38 for displacing the spring fork 13 can be eliminated. Also, the ignition anode 23 is located in an insulator 44 arranged in the breech bottom 8. As a counter-electrode for forming an electrical arc in the channel 24, the breech bottom 8 can be used when the catridge belt 9 is not formed of an electrically conductive foil. All other elements are the same as in the first embodiment.

Figure 8:
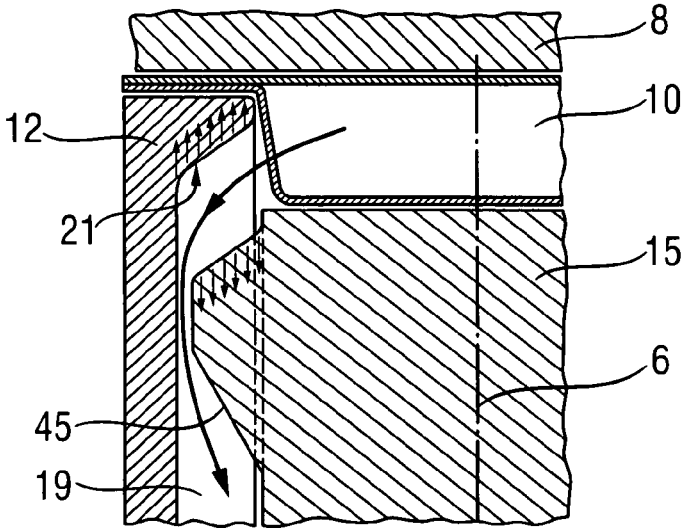
FIG. 8 a cross-sectional view of a sealing sleeve displaceably supported on a guide pin.

FIG. 8 shows a view in which noses 45, which are provided on the guide pin 15 project into the channel 19 of the guide sleeve 12. The noses 45 form choking points between the catridge 10 and the drive piston 3. The choking points advantageously increase the effectiveness of combustion of the propellant. The closer the choking point is to the catridge 10, the more effective is the combustion. The provision of the choking points should be so effected that no surface is available on the sealing sleeve 12 which would be subjected to a force, which is produced by the gas pressure, acting in a direction in which the sealing sleeve 12 is displaced away from the breech bottom 8. On the contrary, increase in the locking force is desired. To this end, the end surfaces 21 at the upper ends of respective channels 19 are used. The end surfaces 21 are, as shown in the drawings are inclined to the central axis 6. When the sealing sleeve 12 is in its upper, locking or sealing position, which is shown in FIG. 8, the propellant in the catridge 10 is ignited, the catridge 10 splinters in its bursting region, to the left in FIG. 8. The gas flows through the choke point formed by the nose 45, and a force acts on the sealing sleeve 12 upward as shown in FIG. 8. The pressure or force acts on the surface 21, i.e., in the closing or sealing direction of the sealing sleeve. The gas channels in the sealing sleeve 12 are formed by the longitudinal channels or grooves 19 formed in the inner wall of the sealing sleeve. A nose 45 projects in each of the elongate channels 19. As it has been described with reference to the embodiment shown in FIGS. 1–3, webs 20 are provided between respective channels 19 with which the sealing sleeve 12 is guided over the guide pin 15. The catridge cannot split in the region of the webs 20. This is necessary to prevent the catridge from coming apart and falling out of the catridge chamber.

Figure 9:
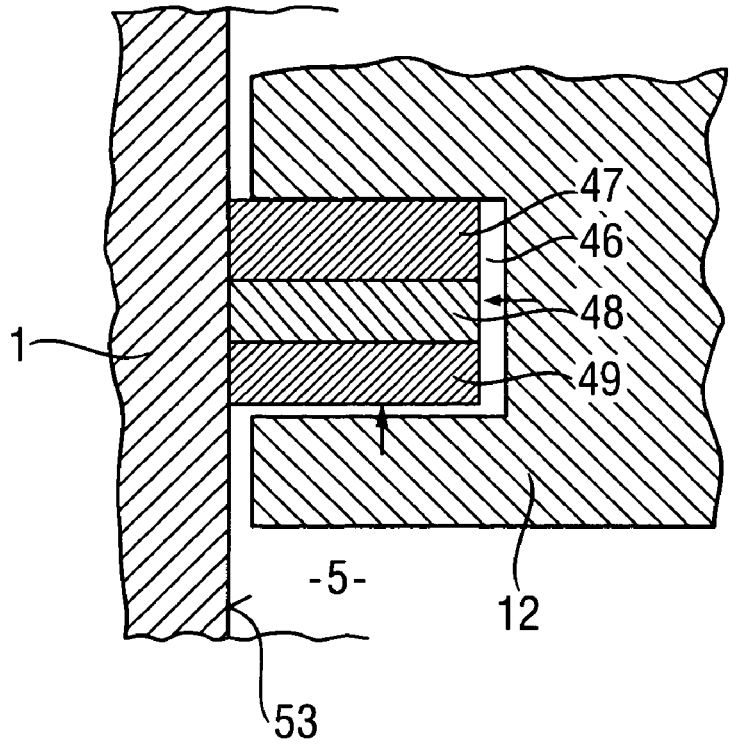
FIG. 9 a cross-sectional view of a sealing arrangement between a sealing sleeve and the housing.

FIG. 9 shows another possibility of sealing of a gap between the sealing sleeve 12 and the cylindrical cavity 5. To this end, the sealing sleeve 12 is provided with an annular groove 46 on its outer circumferential wall and in which at least three FEY-rings 47, 48, and 49 are located. The FEY-rings 47, 48, 49 are formed as split spring rings which are similar to piston rings. With three FEY-rings, the possibility that all three slots or weak points are arranged one above the other is so small that this possibility can practically be eliminated. When the pressure in the catridge support, increases, it penetrates into the groove 46, forcing the rings 47, 48, 49 upward toward the breech bottom 8, on one hand, and radially outwardly against the inner wall of the cavity 5, on the other hand. This insures a reliable sealing of the gap between the inner wall and the sealing rings. The directions of forces acting on the rings 47, 48, 48, 49 are shown with arrows.

Figure 10:
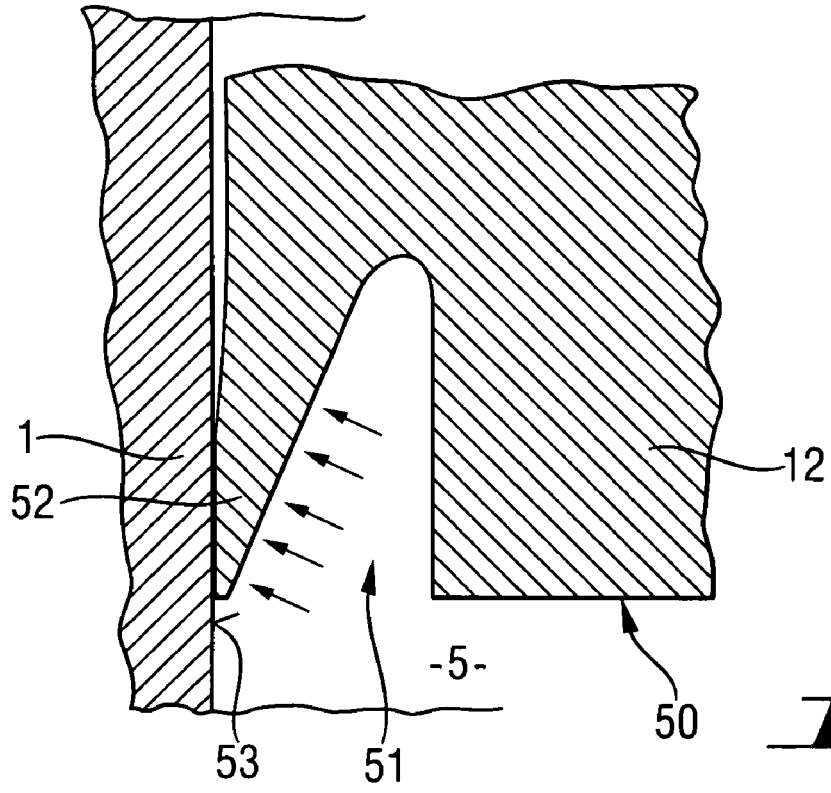
FIG. 10 a cross-sectional view of another embodiment of a sealing arrangement between a sealing sleeve and a housing.

According to FIG. 10, a metallic lip sealing can be provided between the sealing ring 12 and the inner wall of the cavity 5. To this end, a circumferential recess 51 is formed in the end surface 50 of the sealing sleeve 12 remote from the breech bottom. As a result, there is formed a rather thin outer wall section 52 which is pressed against the inner wall 53 of the cylindrical cavity 5 under action of the gas pressure.

As it has already been discussed above, a certain initial tightness should exist upon ignition of the catridge located in the ignition position, when a small gas pressure is produced. This is advantageously achieved by deformation of the catridge foil. This portion of the pressure force can be maintained small by minimizing the deformed surface of the foil. The deformation is effected with as small as possible cut. Because the catridge foil is not punched or pierced through with a very high force at a high gas pressure, the displacement of the sealing sleeve 12 against a stop is prevented, and the cut height is so small that the cut does not extend through the entire foil. The foil is impacted in a flat region.

This permits to easily obtain the desired tolerances as only two dimensions are to be obtained. Also, the support region on the catridge foil is sufficiently large in comparison with the foil thickness. This prevents extrusion of the foil under action of high forces.

The effectiveness of the sealing region in the vicinity of the catridge foil is enhanced by a provision of a sufficiently large gap on a side of the seal remote from the pressure region and in which no forces, which can lead to displacement of the sealing sleeve 12 away from the breech bottom, 8 are produced by the eventually flowing-off gases. This insures pressure on the sealing sleeve 12 in the sealing direction by combustion gases produced upon ignition of the blister catridge 10.

Figure 11:
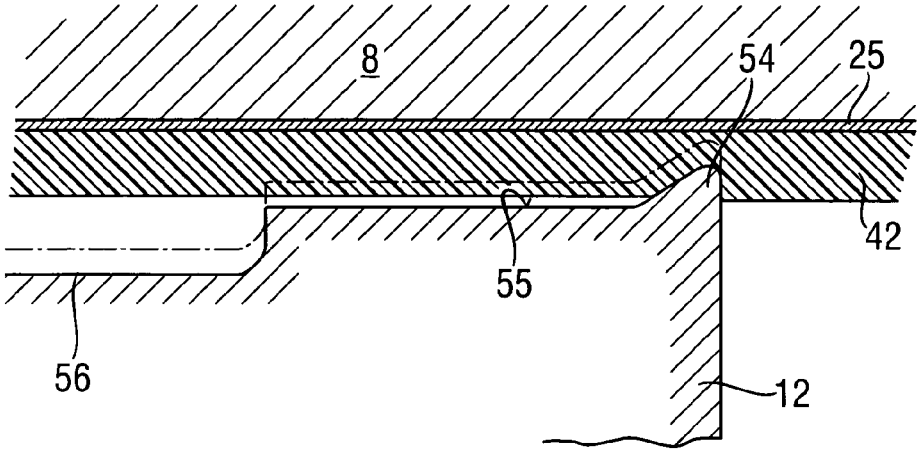
FIG. 11 a cross-sectional view of another embodiment of a sealing sleeve in its region facing a breech bottom.

FIG. 11 shows a possible shape of the end surface of the sealing sleeve 12 facing the breech bottom 8. This end surface of the sealing sleeve 12 has a circumferential nose-shaped projection 54 extending axially upward and radially inward. In FIG. 11, a higher inner pressure is produced on the right. Already at a small gas pressure, the nose-shaped projection 54 penetrates into the blister catridge plastic foil 42, insuring a sufficient initial sealing. At a maximum pressure in the catridge support, the projection 54, further penetrates into the plastic foil 42, but without cutting the same. The flat region 55, which adjoins the nose-shaped projection 54 insures, by abutting the surface of the plastic foil 42, that the foil 42 is hot cut through by the nose-shaped projection 54. The dash line shows the position of the sealing sleeve 12 at a maximum inner pressure. The end surface of the sealing sleeve 12 is further recessed in the region 56.

In case the gases are emitted from the inner space, they cannot cause displacement of the sealing sleeve 12 away from the breech bottom.

Figure 12:
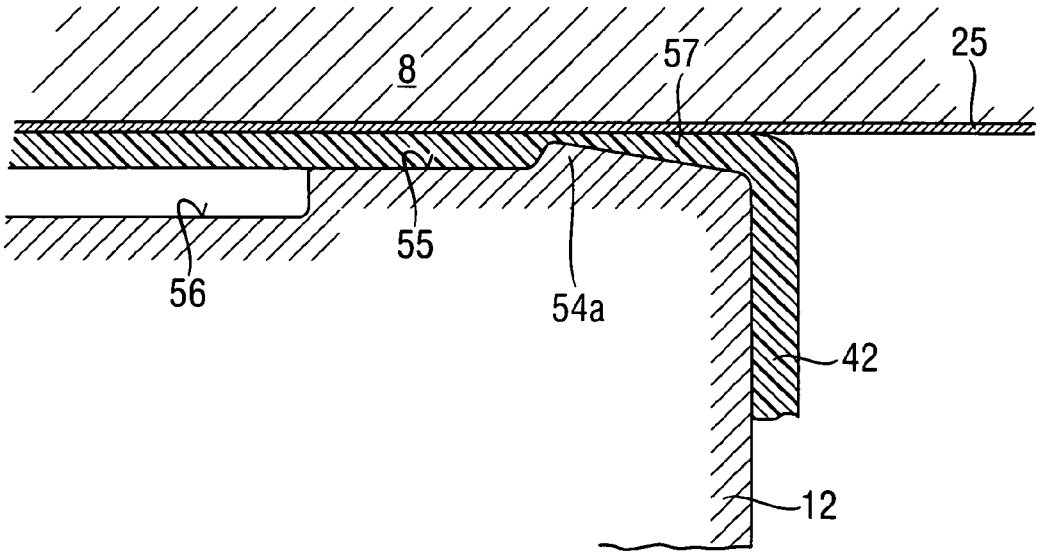
FIG. 12 a cross-sectional view of a further embodiment of a sealing sleeve in its edge region facing the breech bottom.

Another shape of the end surface of the sealing sleeve 12 adjacent to the breech bottom is shown in FIG. 12. As in the embodiment shown in FIG. 11, the combustion or pressure space is located on the right. Here, the nose-shaped projection 54*a* is wedge-shaped and extends toward the breech bottom 8 radially outwardly of the pressure space, forming a radial wedge-shaped slot 57 which is filled with the metal foil 75 and the plastic foil 42. This arrangement insures a reliable initial sealing.

Figure 13:
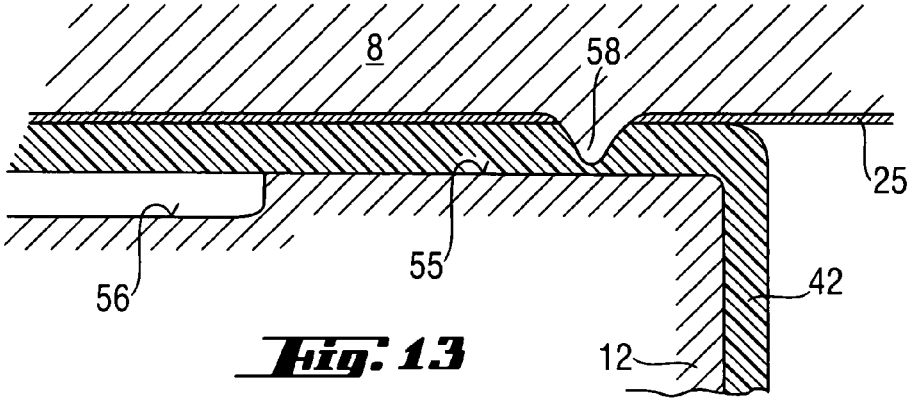
FIG. 13 a cross-sectional view showing a structure of the breech bottom in each region adjacent to the sealing sleeve.
Figure 14:
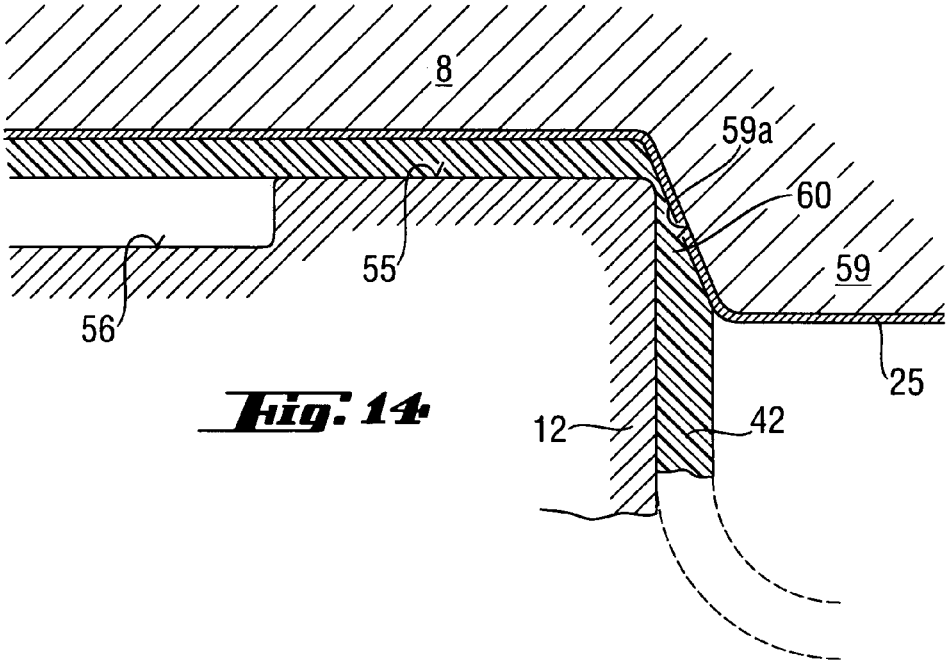
FIG. 14 a cross-sectional view showing a further structure of the breech bottom in its region adjacent to the sealing sleeve.

FIGS. 13 and 14 show other arrangements that insure a reliable initial sealing. In FIG. 13, the end surface 55 of the sealing sleeve 12 adjacent to the breech bottom 8 extends parallel thereto. The breech bottom 8 has a nose-shaped projection 58 extending toward the sealing sleeve 12. When the sealing sleeve 12 is pressed against the breech bottom 8, the projection 58 penetrates through the metal foil 25 and partially into the plastic film 42, whereby a good initial sealing is insured.

In FIG. 14, the adjacent end surface 55 of the sealing sleeve 12 likewise extends parallel to the breech bottom 8 which has a projection 59 shaped as truncated cone and facing the sealing sleeve 12. The circumferential wall 59*a* of the projection 59 extends at angle to the central axis 6 or is inclined to the inner wall of the cavity 5. In this way an axial wedge slot 60 is formed between the inner wall of the cavity 5 and the inclined circumferential wall 59*a* of the projection 59 and into which the foils 25 and the film 42 are squeezed in. This likewise insures a good initial sealing.

Figure 15:
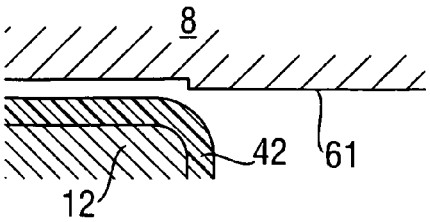
FIG. 15 a cross-sectional view showing a still further structure of the breech bottom.

FIG. 15 shows another shape of the breech bottom 8 in the region of the sealing sleeve 12. In this region, the breech bottom 8 has a washer-shaped projection 61 the circumferential edge of which is located opposite the edge of the sealing sleeve 12. When the sealing sleeve 12 is pressed toward the breech bottom 8, the edge of the circumferential projection 61 penetrates into the plastic film 42 of the catridge 10, providing for the initial sealing. The catridge 10 and the breech bottom 8 are displaced to a stop. The height of the washer-shaped projection 61 is so selected that the projection 61 does not penetrate through the entire plastic film 42. The height of the projection 61 with respect to the breech bottom 8 amounts, e.g., to from 0.1 mm to 0.2 mm. The edge of the projection 61 should not align with the inner wall of the sealing sleeve 12 but should be offset radially to the sealing sleeve 12.

Figure 16:
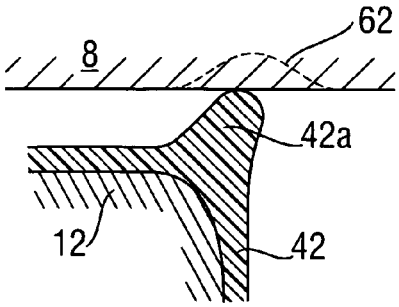
FIG. 16 a cross-sectional view showing the shape of a blister catridge at its side remote from the sealing sleeve.

FIG. 16 shows a shape of the plastic film of a blister catridge at the side of the film adjacent to the breech bottom 8. The breech bottom 8 is completely flat, whereas the plastic film 42 has a nose 42*a* that projects toward the breech bottom 8 and is inclined with respect to a center of the sealing sleeve 12. Upon displacement of the catridge 10 along the breech bottom 8, the nose 42*a* is pressed toward the center of the sealing sleeve 12, with the material of the nose 42*a* being pressed in a wedge slot formed between the breech bottom 8 and the sealing sleeve 12 when an overpressure is produced in the interior of the sealing sleeve 12. In the embodiment of the breech bottom 8 shown in FIG. 16, the breech bottom 8 can be formed with a circumferential or annular recess 62 located opposite the nose 42*a* of the plastic film 42. Upon the displacement of the sealing sleeve 12 toward the breech bottom 8, the nose 42*a* penetrates into the recess 62. Thereby, a very good initial sealing is obtained.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, the present invention includes all variations and/or alternative embodiments within the spirit and scope of the present invention as defined by the appended claims.

What is claimed is:

1. An explosion-operated power tool, comprising:

a housing (1) having a cylindrical cavity (5), a piston chamber (2) for receiving a drive piston (3), and a channel (7) for communicating the piston chamber (2) with the cavity (5);

a breech bottom (8) located opposite the cavity (5) and fixedly secured relative to the housing (1) at a predetermined distance from the housing (1); and a sealing sleeve (12) located in the cavity (5) of the housing (1) and displaceable between a first position in which the sealing sleeve (12) is located axially away from the breech bottom (8) for enabling a sidewise feeding of a cartridge (10) for positioning the cartridge between the breech bottom and the sealing sleeve (12) and in which the sealing sleeve (12) blocks the communicating channel (7), and a second position in which the sealing sleeve (12) adjoins the breech bottom (8) for securing the cartridge between the breech bottom (8) and the sealing sleeve (12) and in which the sealing sleeve (12) does not block the communicating channel (7).

2. A power tool according to claim 1, wherein central axes (4, 6) of the cavity (5) and the piston chamber (2) extend at an angle to each other.

3. A power tool according to claim 2, wherein the central axes of the cavity (5) and the piston chamber (2) form an angle of 90° with each other.

4. A power tool according to claim 1, wherein central axes (4, 6) of the cavity (5) and the piston chamber are coaxially arranged relative to each other.

5. A power tool according to claim 1, wherein the sealing sleeve (12) has surfaces (21, 22) which provide for displacement of the sealing sleeve (12) toward the breech bottom (8) upon action of gas pressure thereon.

6. A power tool according to claim 5, wherein one of the surfaces (22) is defined by a bottom surface of the sealing sleeve (12) and which is spaced from a bottom (16) of the cavity (5) when the sealing sleeve (12) receives the cartridge.

7. A power tool according to claim 6, wherein another of the surfaces (21) is provided at an end of the sealing sleeve (12) facing the breech bottom (6) and formed as an inwardly inclined section of the sealing sleeve (12).

8. A power tool according to claim 1, comprising circumferential seals (29; 47–49; 52) encompassing the sealing sleeve (12).

9. A power tool according to claims 8, wherein the sealing sleeve (12) has at an end thereof remote from the breech bottom (8) a circumferential recess (51) formed in an end surface (50) thereof for forming a thin outer wall section (52) which is pressed against an inner wall (53) of the cavity (5) under action of gas pressure.

10. A power tool according to claim 1, further comprising a guide pin (15) for guiding the sealing sleeve (12) and projecting from the housing (1) into the cavity (5) in a direction toward the breech bottom (8).

11. A power tool according to claim 10, wherein the sealing sleeve (12) has inner elongate channels (19) through which gas pressure, which is produced upon ignition of the cartridge (10), is communicated to the piston chamber (2).

12. A power tool according to claim 11, wherein, noses (15) provided on the guide pin (15) project into the inner channel (19).

13. A power tool according to claim 1, comprising spring means for displacing the sealing sleeve (12) against the breech bottom (8).

14. A power tool according to claim 1, further comprising an actuation element (32) provided at a front end thereof and displaceable relative to the housing (1) for operating a mechanism (36, 37, 38, 13) for displacing the sealing sleeve (12), the displacing mechanism displacing the sealing sleeve (12) toward and away from the breech bottom (8) upon displacement of the actuation element (32) toward the housing (1) and away therefrom, respectively.

15. A power tool according to claim 14, wherein the displacing mechanism comprises a spring fork (13) for retaining the sealing sleeve (12), the spring fork (13) being lifted against a spring force thereof upon displacement of the actuation member (32) toward the housing (1).

16. A power tool according to claim 14, wherein the cartridges (10) are fed in a region between the sealing sleeve (12) and the breech bottom (8) dependent on a displacement position of the actuation element (32).

17. A power tool according the claim 1, wherein cartridges (10) are formed as blister cartridges and are connected with each other forming a cartridge belt (9).

18. A power tool according to claim 17, wherein the cartridges (10) project above one side of the belt (12), with another side of the belt being displaceable along the breech bottom (8), sliding therealong.

19. A power tool according to claim 18, wherein an end surface (55) of the sealing sleeve (12) facing the breech bottom (8) has a circumferential nose-shaped projection (54, 54*a*) extending axially and radially inward.

20. A power tool according to claim 18, wherein the breech bottom (8) has a circumferential nose-shaped projection (58) extending toward an end surface (55) of the sealing sleeve (12) adjacent to the breech bottom (8).

21. A power tool according to claim 18, wherein the breech bottom (8) has a truncated cone-shaped projection (59) extending toward an end surface (55) of the sealing sleeve (12) adjacent to the breech bottom (8), the truncated cone-shaped projection (59) projecting into the sealing sleeve (12) upon displacement of same toward the breech bottom (8).

22. A power tool according to claim 18, wherein the breech bottom (8) has a disc-shaped projection (61) extending toward and end surface (55) of the sealing sleeve (12) adjacent to and parallel to the breech bottom (8) and having a circumferential edge thereof located opposite an inner edge of the sealing sleeve (12).

* * * * *